United States Patent [19]

Jameson

[11] Patent Number: 4,668,382

[45] Date of Patent: May 26, 1987

[54] FLOTATION METHOD

[75] Inventor: Graeme J. Jameson, New Lambton, Australia

[73] Assignee: 501 University Newcastle Research Associates Limited, New South Wales, Australia

[21] Appl. No.: 765,560

[22] Filed: Aug. 13, 1985

Related U.S. Application Data

[63] Continuation-in-part of Ser. No. 661,894, Oct. 17, 1984, abandoned.

[30] Foreign Application Priority Data

Oct. 21, 1983 [AU] Australia ..... PG1988
Jan. 10, 1984 [AU] Australia ..... PG3145

[51] Int. Cl.[4] ..... B03D 1/02; B03D 1/16

[52] U.S. Cl. ..... 209/164; 209/168; 210/221.2; 210/703

[58] Field of Search ..... 209/164, 165, 168, 169, 209/170; 210/221.1, 221.2, 703–707

[56] References Cited

U.S. PATENT DOCUMENTS

| | | | |
|---|---|---|---|
| 864,856 | 11/1907 | Norris | 209/164 X |
| 1,157,176 | 9/1915 | Owen | 209/169 |
| 1,367,332 | 2/1921 | Towne et al. | 209/170 X |
| 1,746,682 | 2/1930 | Ruth, Jr. | 209/170 |
| 2,446,655 | 8/1948 | Lawrason | 210/705 |
| 3,032,199 | 5/1962 | Samiya | 209/170 |
| 3,525,437 | 8/1970 | Kaeding et al. | 210/221.2 |
| 3,772,192 | 11/1973 | Huckstedt et al. | 209/170 X |
| 4,181,614 | 1/1980 | Steenhorst | 209/168 X |
| 4,186,087 | 1/1980 | Kato | 210/221.2 X |

FOREIGN PATENT DOCUMENTS

| | | | |
|---|---|---|---|
| 87383 | 2/1922 | Austria | 209/169 |

*Primary Examiner*—S. Leon Bashore
*Assistant Examiner*—Thomas M. Lithgow
*Attorney, Agent, or Firm*—Fulwider, Patton, Rieber, Lee & Utecht

[57] ABSTRACT

A method of improving the quality of froth removed from a minerals separation flotation cell by providing converging side walls to crowd the froth into a narrower chimney and thereby increase the froth height. The riser is constructed so that the height of the froth from the pulp/froth interface to the froth overflow weir is greater than the natural froth height in a similar parallel-sided flotation cell.

9 Claims, 5 Drawing Figures

FLOTATION METHOD

This is a continuation-in-part of copending application Ser. No. 661,894, filed on 10-17-84, which is now abandoned.

BACKGROUND OF THE INVENTION

This invention relates to an improved flotation method and apparatus and has been devised particularly for improving the purity or grade of concentrate produced from froth emanating from a flotation cell.

It is well known to separate various types of minerals by the process known as flotation using a flotation cell. The mineral to be treated by flotation is finely ground and prepared in a slurry with water. Various reagents are then added to assist in the flotation of the desired species from the slurry. The slurry then passes to a bank of one or more flotation cells.

The flotation cells which are predominantly used in commercial plants are of the mechanical aeration type in which gas bubbles and particles are brought together by vigorous agitation in a stirred tank. Air is introduced to the region of the impeller through the hollow shaft tank. The particles to be floated attach to the bubbles and rise to the surface where they form a separate froth layer. The froth, bearing the valued minerals, is removed from the cell separately from the pulp or slurry containing the unwanted particles.

Other types of flotation cell are used, in which the gas is introduced through fine holes in a pipe, or through a porous medium, in the bottom of the cell. Other variations are to inject the gas into the cell in the form of a mixture with a flowing stream of the slurry, or in solution in the slurry.

In conventional known flotation cells having substantially vertical side walls, the froth from a particular mineral/liquid mixture (known as pulp) in an operating cell will reach a certain height on top of the pulp when aerated according to the cell configuration, construction and method of operation. This height of the froth on top of the pulp is hereby defined as the "natural froth height" as referred to in the remainder of this specification. The major volume of the cell is generally located above the source of bubbles which is frequently a rotating impeller. Most cells are parallel sided in this region although an angled baffle may be provided to "crowd" the bubbles toward a weir located on one side of the cell. Throughout this specification, where reference is made to the horizontal cross-sectional area of the body of the cell, the area referred to is the major or larger area before any reduction by angled baffles etc.

A problem which is encountered with all these known types of cell, relates to the entrainment of unwanted slurry particles into the froth. Where the froth forms just above the surface of the liquid slurry, the rising bubbles carry with them particles of the material to be removed, attached directly to the surface of a bubble and forming a line of contact where the gas in the bubble, the liquid in which the solid particles are suspended, and the surface of a solid particle are all co-existent. In addition, however, some of the slurry is carried into the froth layer in the form of thin films between the individual bubbles. Since this liquid contains unwanted solids at approximately the same average concentration as in the liquid in the cell itself, it is inevitable that unwanted gangue material is entrained into the froth with the particles of values which it was intended to float.

As a consequence of the entrainment of the undesirable gangue particles, the grade or purity of the flotation product or concentrate is reduced. In some cases the purity can be improved by subjecting the froth concentrate to successive flotation treatments, which adds to the cost and complexity of the plant, and may lead to losses of values from the re-treatment flotation cells.

SUMMARY OF THE INVENTION

It is therefore an object of the present invention to provide a method of improving the removal of froth and entrained particles from a flotation cell which will obviate or minimise the foregoing disadvantages in a simple yet effective manner or which will at least provide the public with a useful choice.

Accordingly the invention consists in a method of improving the yield of a minerals separation flotation cell of the type having an aerator in the cell arranged to produce bubbles in liquid pulp within the cell causing a froth to form on top of the pulp to a natural froth height, the cell further incorporating an overflow lip positioned in the side of the cell in the natural froth height allowing the froth, bearing entrained minerals, to overflow into a launder for collection, the method comprising the steps of providing a collecting hood having a lower peripheral edge and inwardly converging sides extending upwardly from the edge to a substantially vertical froth collection shaft having an overflow weir therein, immersing the lower peripheral edge into the cell causing the froth to rise upwardly within the collection shaft and overflow the weir, and positioning the collection hood vertically within the cell so that the height of the froth from the pulp/froth interface to the overflow weir is greater than the natural froth height.

Preferably the collecting hood is positioned and arranged such that the height of the froth from the pulp/froth interface to the overflow weir is greater than the natural height of the froth multiplied by the horizontal cross-sectional area of the hood at the lower peripheral edge and divided by the horizontal cross-sectional area of the collection shaft at the level of the overflow weir.

Preferably the collecting hood is positioned so that the pulp/froth interface is located either in the shaft or slightly below the junction between the shaft and the converging sides of the hood.

It is preferred that the overflow weir and the base of the collecting hood are positioned such that the path length of each bubble from the base to the weir is substantially the same to achieve a uniform quality in the froth flowing over the weir.

DESCRIPTION OF THE DRAWINGS

Notwithstanding any other forms that may fall within its scope, one preferred form of the invention will now be described by way of example only with reference to the accompanying drawings, in which.

DESCRIPTION OF THE PREFERRED EMBODIMENT

The main features of the invention are first described with reference to FIG. 1, which shows a flotation cell 1 of conventional design, to which has been fitted the preferred embodiment as shown on the left hand side of FIG. 1. The flotation cell may be of any suitable dimensions, and is here shown with a central impeller 20 which serves to agitate the contents of the cell, and acts also as a source of small bubbles. The impeller is rotated by a hollow shaft 21. The slurry of suspended solids enters and leaves the cell by any suitable combination of pipes, valves, or weirs (not shown).

The fine bubbles of gas collide with the mineral particles to be floated and carry them upward to the surface of the liquid slurry. In conventional practice, as shown in the right hand side of FIG. 1, the bubbles form a froth layer above the liquid pulp, and the froth flows over a suitably-placed lip or overflow weir into a common launder or open channel 7, to flow to the next stage of the process.

The difference in level between the top of the froth layer 3*b* in a conventional flotation cell, and the pulp/-froth interface 3*a*, is the 'natural froth height' defined herein.

Figure 1:
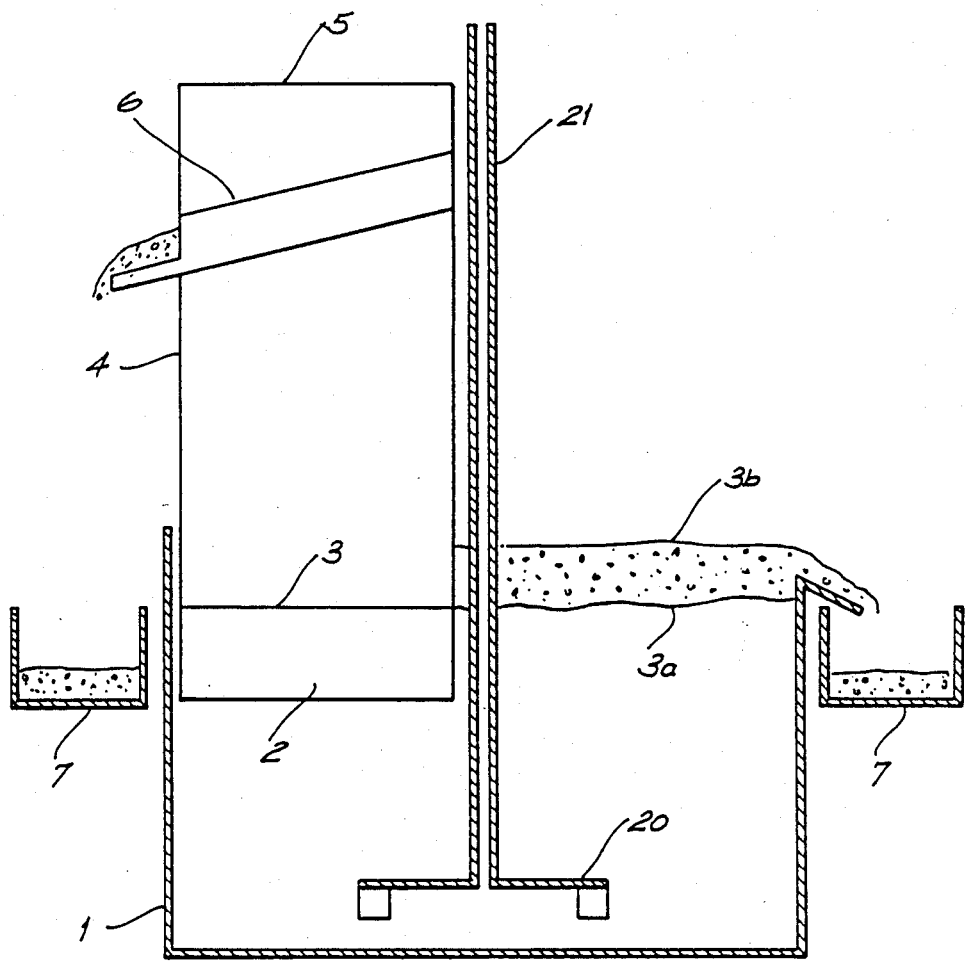
FIG. 1 is a vertical section through one embodiment of a flotation cell suitable for use in a method according to the invention.
Figure 2:
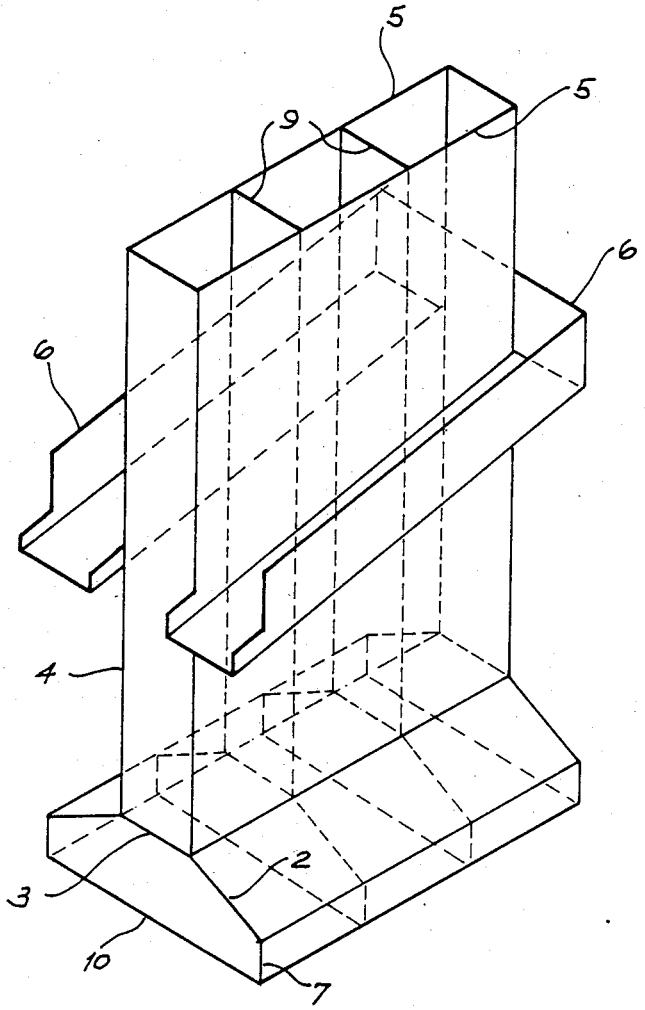
FIG. 2 is a diagrammatic perspective view of one hood, chimney and weir used in the cell shown in FIGS. 1 and 2.

In the method according to the invention as shown in the embodiment placed over the top of an existing cell as in the left hand side of FIG. 1 (see also FIG. 2), the bubbles enter a hood or cover 2 placed over the top of the liquid slurry, and are directed to the base of a rising shaft or 'chimney' 4 in the centre of the hood. The hood has upwardly and inwardly convering side walls, so that the horizontal cross-sectional area of the froth stream is reduced as it rises upwardly.

When the bubbles enter the shaft 4 of the assembly, they entrain considerable quantities of slurry containing an amount of unwanted gangue materials. As the froth rises in the shaft, the concentration of the gangue particles in the liquid in the froth decreases, and if the height of the shaft is sufficient, the concentration of entrained gangue in the froth leaving the top opening of the shaft can be reduced to a low value.

The froth containing the concentrated valuable material leaves the top 5 of the froth column, which acts as an overflow weir, and spills over into a launder or open-topped channel 6, in which it flows to one end or both of the flotation cell to discharge into a common launder 7 and thence away to the next treatment stage.

The bottom 3 of the rising shaft coincides approximately with the pulp/froth interface level 3*a* in the flotation cell, which is controlled by a suitable combination of valves and weirs (not shown).

Although it has been found most efficient to locate the bottom of the shaft or chimney 4 at the pulp/froth interface 3*a* it has been found that the method according to the invention will also operate with the pulp/froth interface higher in the chimney so long as the froth height from the pulp/froth interface to the weir 5 is greater than the natural froth height as herein defined. It is also possible to operate the apparatus with the pulp/froth interface located below the base of the chimney although this results in crowding of the froth layer which can cause degradation of the froth.

With the collecting hood positioned so that the base of the froth column 3 is at approximately the same level as the pulp/froth interface, the bottom 10 of the bubble collecting hood should extend sufficiently deeply into the slurry to maintain at all times a liquid seal which prevents escape of the captured bubbles as a result for example of wave action induced by the rotating impeller.

The area of cross-section of the shaft 4 perpendicular to the mean direction of flow of the froth, is considerably less than the area of cross-section of the base of the hood 2. Accordingly the height to which the froth rises in the shaft is increased relative to the height of the same froth in a flotation cell which is not modified according to the invention.

It has been found in fact that the froth height is increased at least to a height given by the following formula:

$$\text{natural froth height} \times \frac{\text{cross sectional area of cell}}{\text{cross sectional area of rising shaft}}$$

and in fact rises of one third as much again an anticipated by this formula can be expected. In many prior art cells efforts have been made to skim off the froth at points below the natural height of the froth layer whereas in the present invention the froth is encouraged to rise to a height much greater than the natural froth height before flowing over the lip or overflow weir.

It is a further feature of the invention that the path length of each bubble in the froth from the point at which it enters the froth to the final overflow weir is substantially the same, which gives a consistent quality throughout the froth and enables the overflow weir to be accurately positioned to achieve the desired quality in the end product.

The vertical shaft 4 of the froth collector may contain vertical baffles 9 (FIG. 2) which serve to guide the froth upward.

The invention has been described with reference to a froth collection shaft 4 which is essentially rectangular. However, the invention does not require that the cross-section be rectangular, and the cross-section shaft may be of any convenient geometrical shape to suit the cell to which it is applied.

The essential attributes of the invention are now given in relation to the flotation cells which are customarily used in industrial practice, in which the superficial velocity of the gas rising in the cell is typically in the range 0.6 to 2 m/s.

The angle which the roof of the hood 2 bears to the horizontal may be any convenient angle, but desirably should be in the range 20° to 30°.

The ratio of the cross-sectional area of the foam shaft 4, to the area of cross-section of the open bottom of the bubble collector hood 2, may be between 99:100 and 1:100, but should preferably be in the range 99:100 to 1:5 for best practical results.

The invention has been described as if the bubble collecting hood 2 and the froth collecting shaft 4 formed a separate entity which could be installed in an existing flotation cell of conventional design. The invention also embraces an arrangement in which the collecting hood and rising shaft are an integral part of the flotation cell 1.

It is desirable to be able to control the height of the top 5 of the froth collection shaft, i.e. the height of the overflow weir above the mean liquid level in the flotation cell, in order to achieve a measure of fine control on the amount of entrained gangue which leaves the froth column with the concentrate. This can be achieved by raising or lowering the complete arrangement in the cell, relative to the surface of the liquid slurry.

In an alternative arrangement, the froth column 4 may be constructed in such a way that its overall height may be increased or reduced by a convenient telescopic mechanism, in which one part of the shaft slides inside another, or by the addition or subtraction of segments of shaft with the same cross-sectional area, and of a convenient incremental height.

Figure 3:
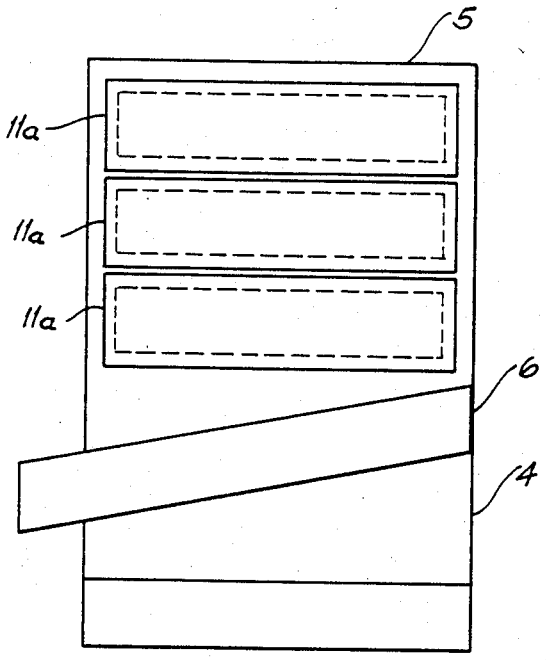
FIG. 3 is a side elevation of a version of the assembly shown in FIG. 3 showing openings with removable covers for adjustment of the weir height.

In another arrangement, the froth shaft has a series of horizontal openings or slots fitted with removable covers as shown in FIG. 3. With all covers in place the froth will rise up the shaft to spill over at the top lip, 5. If it is desired to remove the froth at a lower level, one or more covers 11*a* may be removed.

The froth shaft 4 may be constructed in such a way that its walls are vertical and parallel and the froth flow cross-sectional area is constant. It may also be constructed so that the cross-sectional area increases or decreases with height. It is preferred to arrange the configuration so that the froth height from the pulp/-froth interface to the weir is greater than the smallest width of the chimney.

Figure 4:
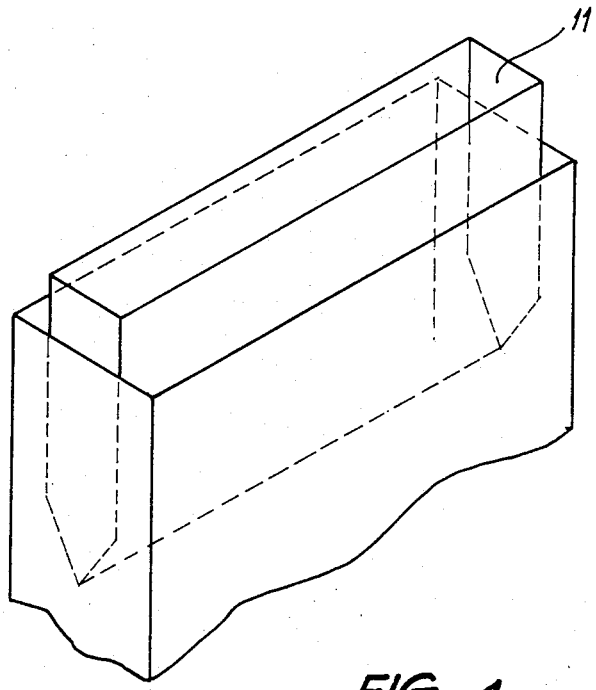
FIG. 4 shows diagrammatically the location of an internal flow-area reducer.

While the froth is rising in the froth collection shaft 4, the liquid in the froth tends to drain downward into the pulp, rendering the froth more viscous and 'sticky'. To assist the froth to flow upward and out of the shaft, it has been found advantageous to insert an object 11 of convenient shape as shown in FIG. 4. By reducing the available flow area, the froth average velocity can be increased to assist removal of the froth.

Figure 5:
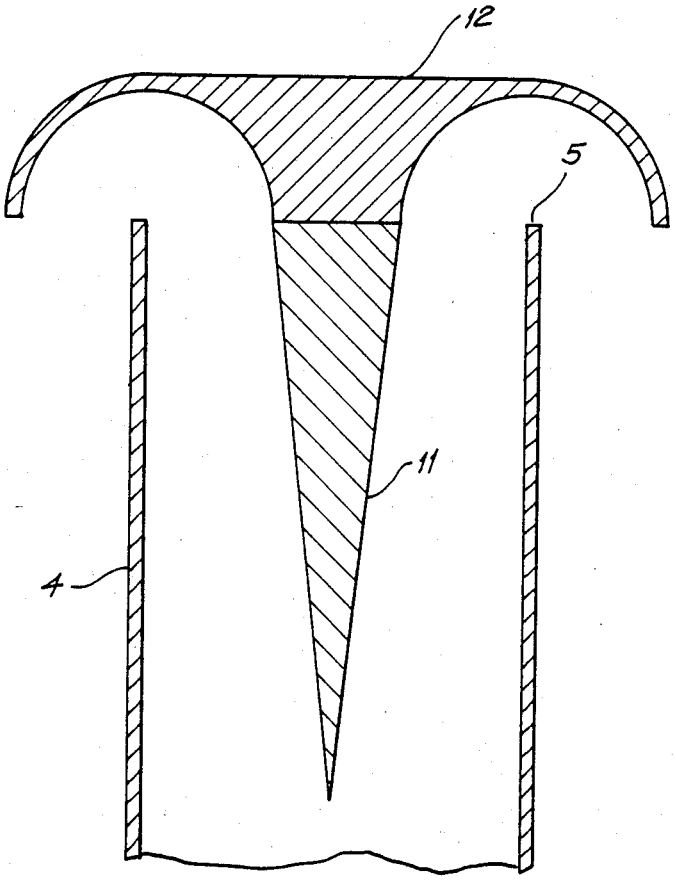
FIG. 5 is a vertical section through a froth shaft showing the location of an area-reducing insert and froth directing cowl.

The area-reducing object 11 depicted in FIG. 4 may be of any suitable shape. A possible alternative configuration is shown in FIG. 5.

A further modification comprises a cowl or deflector plate 12 (FIG. 5) which may be used alone or in conjunction with the flow area reducer 11, in order to direct the upwardly moving froth so that it flows horizontally over the lip 5 and is then directed downward into the launder 6.

The improvement in purity of the froth flowing over the overflow weir (by way of the reduction of entrained gangue) will be demonstrated with reference to an experimental example.

A model of the froth cleaning device was tested in an operating flotation cell. The model consisted of a plastic pipe of internal diameter 150 mm, length 120 mm, which was connectd to another pipe of internal diameter 75 mm, through a reducer. The smaller-diameter pipe or column was formed by a number of short segments which could be screwed together so as to increase its length.

The operational flotation cell was of conventional design, with a single impeller centrally located. Air was introduced through the hollow impeller shaft. A froth crowder was incorporated in the rear of the cell to force the froth forward to the overflow lip and thence into a launder for further processing. The cross-sectional dimensions of the cell were 900 mm by 900 mm, and the area of the normal froth layer was 900 mm by 600 mm.

The cell was treating a low-grade sulphide ore. The normal depth of the froth was 180 mm and the pulp surface was 50 mm below the overflow lip.

The column was mounted vertically in the cell, with the larger-diameter pipe lowermost, and positioned so that the base of the column of narrower section was approximately at the same level as the froth/pulp interface. Bubbles rising in the pulp were collected by the larger pipe and thus forced together into the base of the column, with a fourfold reduction in cross-sectional flow area, to form a rising body of froth. The froth eventually flowed out of the top of the column, where samples could be taken for analysis.

Segments of pipe were added to increase the overall height of the column, and samples were taken at the different heights.

The following table shows a comparison of the gangue (non-sulphide) mineral in the froth concentrate from the cell in normal operation, with the gangue in the product from the froth column at various heights above the froth/pulp interface:

| | Froth depth mm | Entrained Gangue. wt % |
|---|---|---|
| Normal concentrate from operating cell | 180 | 65 |
| Concentrate from froth column | 700 | 56 |
| | 800 | 43 |
| | 1000 | 20 |
| | 1100 | 6 |

It will be seen that there is a very marked reduction in the percentage of entrained gangue (impurities) at higher froth heights. In this particular example if the natural froth height of 180 mm is taken, and multiplied by the ratio of the area of the larger diameter pipe to the area of the smaller diameter pipe, then a height of 720 mm is obtained. It is noticable from the test result that any froth at heights greater than 720 mm give a substantial improvement in entrained gangue over the normal concentrate from the operating cell.

In this manner it can be seen that prior art attempts to skim the froth from the top of a flotation cell, and in so doing to reduce the natural froth height either by the use of mechanical skimming apparatus or by lower overflow weir positioning are misdirected and that substantially improved results may be achieved by increasing the height of the froth from the pulp/froth interface to the overflow weir.

What I claim is:

1. A method of improving the yield of a minerals separation froth flotation cell employed in the separation of one mineral from another, the cell being of the type having aerator means in the cell for producing bubbles in the liquid pulp within the cell causing a froth to form on top of the pulp to a natural froth height, the cell further incorporating an overflow lip positioned in the side of the cell at a height between the pulp/froth interface and the top of the froth allowing the froth, bearing entrained minerals, to overlow into a launder for collection, the method comprising the steps of providing a collecting hood having a lower peripheral edge and inwardly converging sides extending upwardly from the edge to a substantially vertical froth collection shaft havig an overflow weir therein, immersing the lower peripheral edge into the cell to a sufficient depth to cause the froth to rise upwardly within the collection shaft and overflow the weir thereby defining a new froth height from the pulp/froth interface to the weir, the collection shaft having a sufficient vertical dimension such that when said lower edge is immersed in said cell to said sufficient depth the new froth height is greater than the natural froth height.

2. A method as claimed in claim 1 wherein the collecting hood is positioned and arranged such that the height of the froth from the pulp/froth interface to the overflow weir is greater than the natural height of the froth multiplied by the horizontal cross-sectional area of the hood at the lower peripheral edge and divided by the horizontal cross-sectional area of the collection shaft at the level of the overflow weir.

3. A method as claimed in claim 1 wherein the walls of the froth collection shaft are substantially parallel and wherein the collecting hood is positioned within the cell to locate the pulp froth interface within the froth collection shaft.

4. A method as claimed in claim 3 wherein the froth height from the pulp/froth interface to the overflow weir is greater than the smallest transverse width of the froth collection shaft.

5. A method as claimed in claim 1 wherein the collecting hood is positioned to locate the pulp/froth interface at or about the base of the froth collection shaft.

6. A method as claimed in claim 1 wherein the collecting hood is positioned to locate the pulp/froth interface between the lower peripheral edge of the hood and the base of the froth collection shaft.

7. A method as claimed in claim 1 wherein the configuration of the collecting hood and the position of the overflow weir is such that the path length of each bubble from the pulp/froth interface to the oveflow weir is substantially the same.

8. A method as claimed in claim 1 wherein the ratio of the horizontal cross-sectional area of the froth collection shaft at the level of the overflow weir to the horizontal cross-sectional area of the collecting hood at the lower peripheral edge is between 99:100 and 1:100.

9. A method as claimed in claim 8 wherein the said ratio is between 99:100 and 1:5.

* * * * *

UNITED STATES PATENT AND TRADEMARK OFFICE

CERTIFICATE OF CORRECTION

PATENT NO. : 4,668,382

DATED : May 26, 1987

INVENTOR(S) : Graeme J. Jameson

It is certified that error appears in the above-identified patent and that said Letters Patent is hereby corrected as shown below: Title page, Item [73]:

Please correct the Assignee by deleting "501 University Newcastle Research Associates Limited" and inserting --The University of Newcastle Research Associates Limited--.

Signed and Sealed this

First Day of December, 1987

*Attest:*

DONALD J. QUIGG

*Attesting Officer*

*Commissioner of Patents and Trademarks*